US007216068B2

(12) United States Patent
Li et al.

(10) Patent No.: US 7,216,068 B2
(45) Date of Patent: May 8, 2007

(54) DIGITIZED THERMAL FUNCTIONAL DESIGN OF TEXTILES AND CLOTHING

(75) Inventors: Yi Li, Kowloon (HK); Edward Newton, Kowloon (HK); Burley Zhong Wang, Kowloon (HK)

(73) Assignee: The Hong Kong Polytechnic University, Kowloon (HK)

( * ) Notice: Subject to any disclaimer, the term of this patent is extended or adjusted under 35 U.S.C. 154(b) by 648 days.

(21) Appl. No.: 09/840,462

(22) Filed: Apr. 24, 2001

(65) Prior Publication Data

US 2002/0156606 A1 Oct. 24, 2002

(51) Int. Cl.

| | |
|---|---|
| ***G06G 7/48*** | (2006.01) |
| ***G06F 19/00*** | (2006.01) |
| ***G01N 25/18*** | (2006.01) |
| ***A41H 43/00*** | (2006.01) |

(52) U.S. Cl. ..... 703/6; 703/2; 703/7; 703/11; 700/130; 700/131; 700/133; 700/135; 374/44; 223/1

(58) Field of Classification Search ..... 703/5, 703/2, 7, 11, 6; 374/44; 700/130–133, 135; 223/1

See application file for complete search history.

(56) References Cited

U.S. PATENT DOCUMENTS

| | | | | |
|---|---|---|---|---|
| 5,341,305 | A * | 8/1994 | Clarino et al. | 700/132 |
| 5,495,568 | A * | 2/1996 | Beavin | 700/83 |
| 5,555,505 | A * | 9/1996 | Oosawa et al. | 700/136 |
| 5,749,259 | A * | 5/1998 | Hamouda et al. | 73/159 |
| 6,408,256 | B1 * | 6/2002 | Hittle et al. | 702/130 |
| 6,473,671 | B1 * | 10/2002 | Yan | 700/134 |
| 6,581,677 | B2 * | 6/2003 | Dukes-Dobos et al. | 165/11.1 |
| 6,584,465 | B1 * | 6/2003 | Zhu et al. | 707/6 |
| 6,624,843 | B2 * | 9/2003 | Lennon | 348/61 |
| 2002/0103566 | A1 * | 8/2002 | Gadson | 700/132 |
| 2002/0156605 | A1 * | 10/2002 | Zhang et al. | 703/11 |
| 2003/0156619 | A1 * | 8/2003 | De Monte et al. | 374/44 |

OTHER PUBLICATIONS

OTT: Cool Care—Thermal Comfort Manikin. http://www.ott.doe.gov/coolcar/manikin.html. Printed Sep. 19, 2004.*

OTT: Cool Car—Human Thermal Comfort Model. http://www.ott.doe.gov/coolcar/computer.html. Printed Sep. 19, 2004.*

Thermal Manikin History http://www.mtnw-usa.com/thermalsystems/history.html. Printed Sep. 19, 2004.*

Huizenga et al., "An Improved Multinode Model of Human Physiology and Thermal Comfort". Proceedings of IBPSA Building Simulation '99. Sep. 13-15, 1999. vol. 1, pp. 353-359.*

(Continued)

*Primary Examiner*—Paul Rodriguez
*Assistant Examiner*—Ayal Sharon
(74) *Attorney, Agent, or Firm*—Leydig, Voit & Mayer, Ltd.

(57) ABSTRACT

Visual thermal functional textile clothing designs are created using a programmed computer and advanced computing techniques. The computer is supplied with information from a number of databases relating to human body properties and relating to textile material characteristics. The method is used to generate functional designs that are visually displayed for use by a textile designer or engineer.

7 Claims, 3 Drawing Sheets

OTHER PUBLICATIONS

Huizenga, C. "Window Performance for Human Thermal Comfort." 2000 ASHRAE Winter Meeting. Feb. 5-9, 2000.*
Gonzalez et al. "Heat Strain Models Applicable for Protective Clothing Systems: Comparison of Core Temperature Response." Journal of Applied Physiology. 1997. vol. 83, pp. 1017-1032.*
Shender et al. "Cold Water Immersion Simulations using the Wissler Texas Thermal Model." Aviat. Space Environ Med. Jul. 1995. vol. 66, Issue 7, pp. 678-686. Abstract Only.*
Nyberg et al. "Model of Human/Liquid Cooling Garment Interaction for Space Suit Automatic THermal Control." Journal of Biomech Eng. Feb. 2001. vol. 123, Issue 1, pp. 114-120. Abstract Only.*
Han, T., Huizenga, C., et al. "Virtual Thermal Comfort Engineering." SAE Technical Paper Series No. 2001-01-0588. SAE 2001 World Congress. Mar. 5-8, 2001.*
R.L. Barker et al. "Transport Phenomena In Comfortable Passive and Active Barrier Textile Systems Code." National Textile Center Annual Report. Aug. 1995. http://www.p2pays.org/ref/08/07018.pdf.*
H. Hamouda et al. "Modeling of Thermal Protection Outfits for Fire Exposure." National Textile Center Annual Report. Nov. 2001. NTC Project I10-S02. http://www.ntcresearch.org/pdf-rpts/AnPp01/I01-S02-A1.pdf.*
P. Bajaj et al. Protective Clothing. 1992. Abstract Only. http://www.library.tuiasi.ro/ipm/vol13no34/textile.html.*
H. Okabe "Three Dimensional Apparel CAD System". Proc. 19th Int'l Conf. on Comp. Graphics and Interactive Techniques. 1992.*
Li, Y. et al.; "Integrated CAD for functional textiles and apparel", *Inst. of Textiles and Clothing, The Hong King Polytechnic Univ.*, Hung Hom, Kowloon, Hong Kong, pp. 8-11, in Ergonomics of Protective Clothing, Proceedings of NOKOBETEF 6 and 1st European Conference on Protective Clothing, Stockholm, Sweden, May 7-10, 2000.
Hu, J. et al.; "Psycho-physiological mechanisms of thermal and moisture perceptions to the touch of knitted fabrics", *Inst. of Textiles and Clothing, The Hong Kong Polytechnic Univ.*, Hung Hom, Kowloon, Hong Kong, pp. 102-106, Ergonomics of Protective Clothing, Proceedings of NOKOBETEF 6 and 1st European Conference on Protective Clothing, Stockholm, Sweden, May 7-10, 2000.
Luo, Z. et al.; Heat preservation behavior of diving suit, *Inst. of Textiles and Clothing, The Hong Kong Polytechnic Univ.*, Hung Hom, Kowloon, Hong Kong, pp. 255-258,Ergonomics of Protective Clothing, Proceedings of NOKOBETEF 6 and 1st European Conference on Protective Clothing, Stockholm, Sweden, May 7-10, 2000.

* cited by examiner

DIGITIZED THERMAL FUNCTIONAL DESIGN OF TEXTILES AND CLOTHING

BACKGROUND OF THE INVENTION

1. Field of the Invention

The invention relates to digitized thermal functional design of textiles and clothing.

2. Description of Prior Art

The invention relates more particularly to the development of using computer technology to provide designs and design data for use in preparing and assessing suitable textiles for human apparel taking into account various thermal characteristics of the human body and available textile materials. Objective matching of those characteristics could enable articles of clothing and textiles to be created and designed. In this respect, data has already been amassed about such characteristics but has not been applied comprehensively with digitized modeling of the thermal physiology of the human body and heat and moisture transfer of the material, in a manner that can be practically applied by textile clothing designers, engineers and scientists.

SUMMARY OF THE INVENTION

It is an object of this invention to overcome this problem.

According to the invention there is provided a method of creating thermal functional designs of textiles and clothing using a computer and visual display monitor controlled by the computer, the method comprising supplying the computer with information from databases relating to thermal physiological characteristics of a human body and thermal characteristics of chosen textile materials for computational simulation of the information, and creating visual images for the monitor showing modules of thermal functional designs.

The database of the human body may comprise human model data for specific body functions, including size and shape.

The database of the garments may comprise clothing patterns data and product specification data.

The database of the human body may comprise thermal property data, including thermo-physiological and thermal comfort data of human body.

The textile materials may comprise thermal property data, including fibres, yarns, fabrics and garments.

BRIEF DESCRIPTION OF THE DRAWINGS

A method of creating thermal functional designs according to the invention will now be described by way of example with reference to the accompany drawings in which:-

DESCRIPTION OF THE PREFERRED EMBODIMENTS

Figure 1:
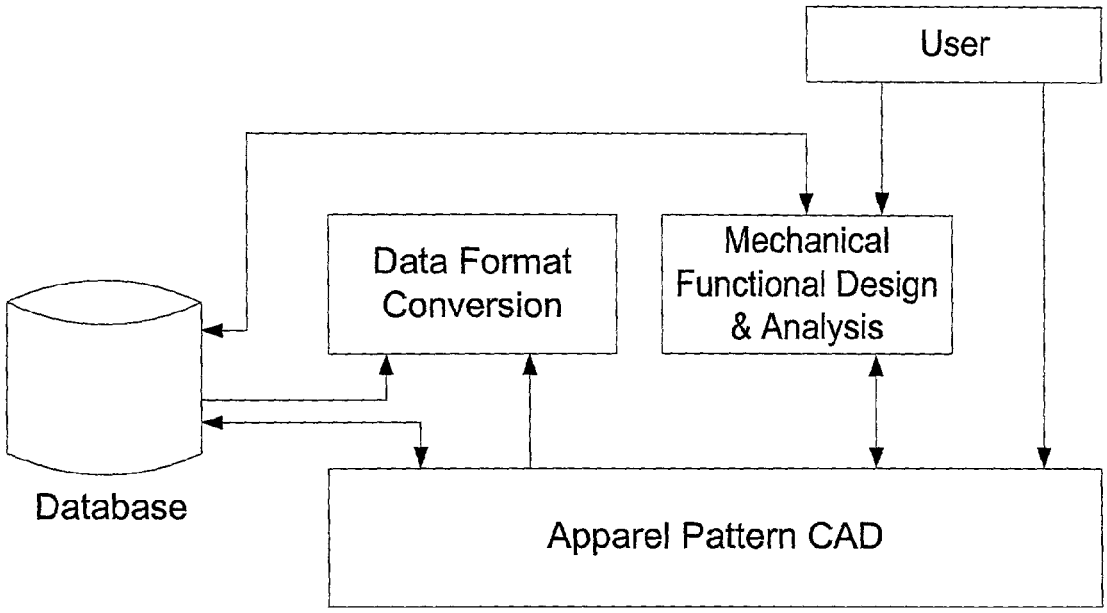
FIG. 1 is an overall schematic view of the method.

Referring to the drawings, in FIG. 1 a textile designer or engineer ("user") selects his requirements and inputs to a computer, represented in this Figure as programmed to carry out Data Format Conversion and Thermal Functional Design and Analysis. The computer is also programmed to control an Apparel Pattern CAD function that can be said to represent, in effect, a visual display monitor that is controlled by the computer, to create modules of functional designs.

In use, databases representing thermal and physiological characteristics of a human body and thermal characteristics of textile materials are called-up for supply to the computer. Data is logically matched or manipulated to create the required modules. Such characteristics and properties have been already amassed and established in databases known in the art. An example is set forth in Li, et al., *Integrated CAD for functional textiles and apparel*, published in Ergonoomics of Protective Clothing, Proceedings of NOKOBETEF 6 and 1st European Conference on Protective Clothing, Stockholm, Sweden, May 7–10, 2000, which is herein incorporated by reference in its entirely. Such databases relate to human models, patterns of apparel products, human thermo-physiological characteristics, and thermal comfort knowledge. The databases also relate to textile information including thermal properties and structure parameters of clothing materials generally, of different fibres, yarns, fabrics, and garments, and of human skin and tissues. Advanced computing technologies developed on the basis of advanced mathematical modelling of the thermo-physiology of the human body and heat and moisture transfer of the clothing materials, are incorporated by the computer to integrate and process the information available from the databases. The information is used to create a number of modules to enable a textile designer or engineer to objectively design apparel and textile articles to serve any number of standard or specialized end-uses.

Figure 2:
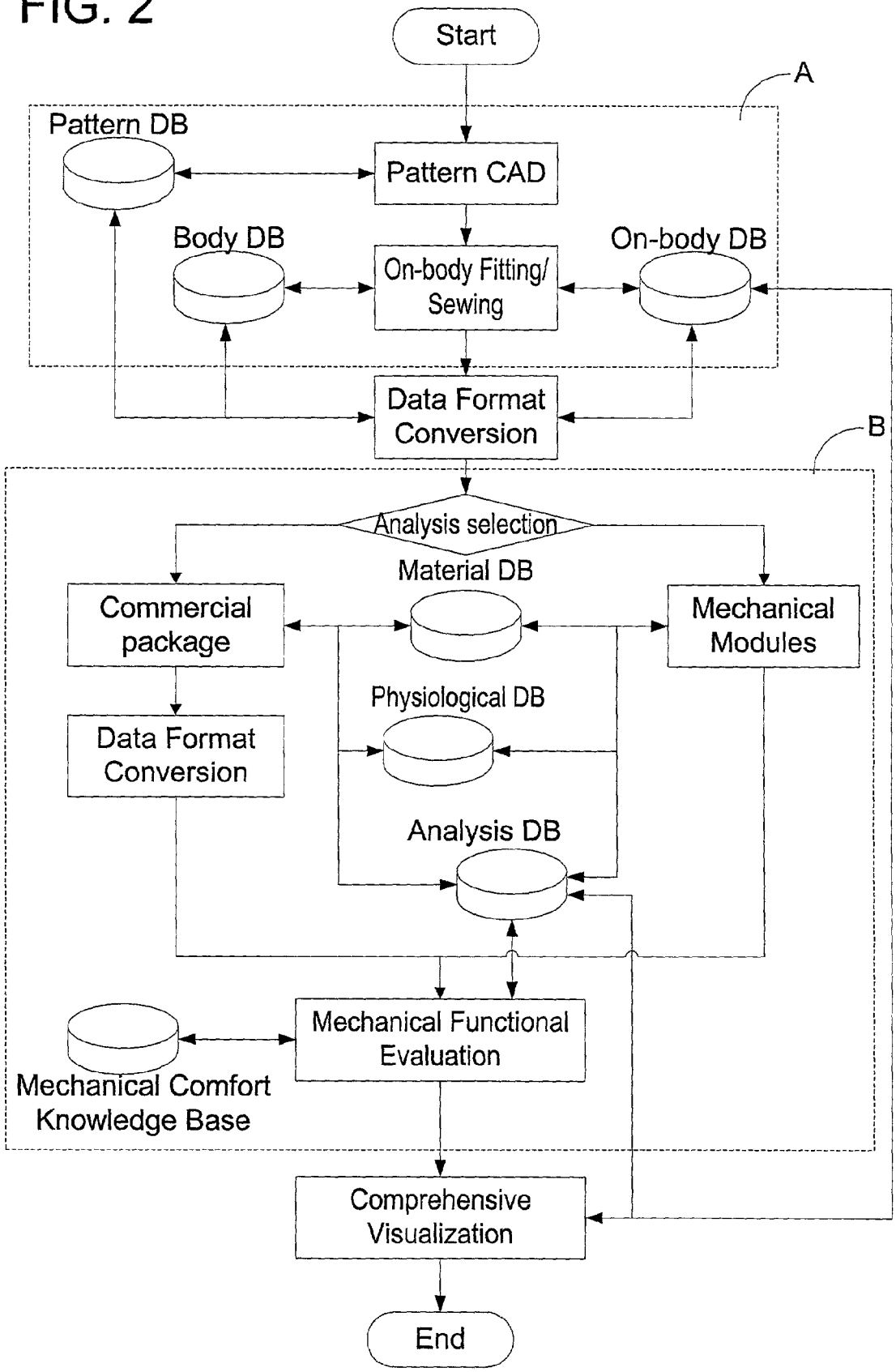
FIG. 2 is a flow diagram of a structural arrangement of the method.

In FIG. 2, the flow chart shows the structural arrangement of the method. In a block A, the thermo-physiological characteristics of a human body are considered together with a chosen pattern of a selected article of clothing. A digitised clothed human body is transformed to specific data format for supply to a block B.

In the block B, computational mathematics using commercially available packages or specially designed software packages with special Data Format Conversion, are used to logically match and compute information from thermal databases relating to the textile materials. A thermal functional evaluation is provided that is compared with data from a Thermal Comfort Knowledge database, which is derived from practical information amassed from knowledge about thermal comfort of apparel. An output is provided to create and display a Comprehensive Visualisation.

Figure 3:
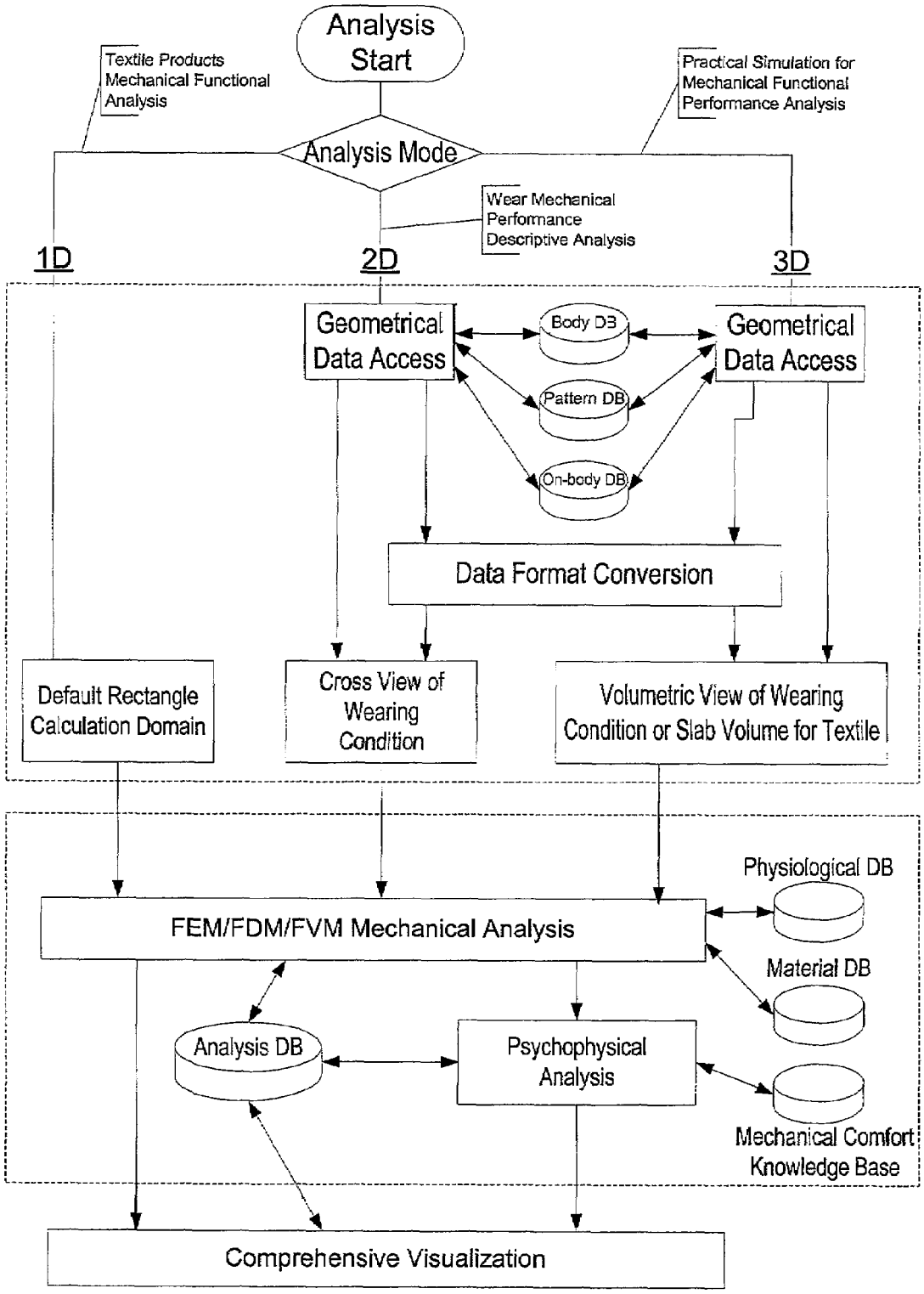
FIG. 3 is a flow diagram of a processing arrangement of the method.

In FIG. 3, the processing chart shows three possible channels that can be used. 1D represents a single dimension, which is a consideration of "thickness" through an article of clothing, say. 2D takes into account areas of clothing and 3D represent 'volumetric' considerations. Thus, it is possible to consider and to create visualizations in 1D, 2D or 3D formats. Although appropriate databases are already available for supplying appropriate information for all three processing channels, comprehensive computational mathematical solutions for 3D processing are at present significantly more expensive. Thus, in practice simpler less comprehensive solutions are selected for 3D processing. In carrying out the methods of the invention, whilst a less comprehensive 3D solution may be used, for the most part more comprehensive solutions used in 1D and 2D channel processes provide sufficient or adequate aid for textile designers and engineers.

Thus, it will be apparent that methods of the invention are provided by applying computer technology to compute and visualize thermo-physiological behaviour of human body and heat-moisture transfer in textile materials based on developed databases relating thermal functional characteristic of a human body and textile articles and materials. By using appropriate established and specially developed computational mathematics with logical matching of such information, a computer is programmed to generate visual images of suitable fabrics, articles of apparel and the like for use by a textile designer or engineer when creating new items of clothing for normal or specialised application as appropriate or desired.

We claim:

1. A method of creating thermal functional designs of articles of clothing using a computer and a display monitor controlled by the computer, the method comprising:

with the aid of an apparel computer aided design function, entering designs of articles of clothing in a pattern database;

supplying the computer with information from databases relating to thermal and physiological characteristics of a human body and thermal characteristics of respective textile materials for making the articles of clothing;

with the computer and using the pattern database, simulating thermal functional performance of the articles of clothing; and creating visual images displayed on the monitor, visualizing thermal functional performance of the designs of the articles of clothing.

2. The method according to claim 1, in which the database of the physiological characteristics of a human body comprises human model data for specific body characteristics, including size and shape.

3. The method according to claim 1, in which the database of thermal characteristics of respective textile materials comprises product specification data.

4. The method according to claim 1, in which the database of thermal characteristics of the human body comprises thermal property data, including thermo-physiological and thermal comfort data of the human body.

5. The method according to claim 1, in which the database of the thermal characteristics of textile materials comprises thermal property data, including data for fibres, yarns, fabrics, and garments.

6. A method of creating thermal functional designs of articles of clothing, the method comprising:

extracting a pattern for an article of clothing from a pattern database;

selecting thermal-physiological characteristics of the human body from a body database;

selecting thermal characteristics of a textile material from a textile database; and simulating fitting on the human body of the article of clothing made from the textile selected and, using the thermal-physiological characteristics selected, displaying a visual image of thermal comfort of a human wearing the article of clothing made from the textile, visualizing thermal functional performance of the article of clothing.

7. The method according to claim 6 wherein the textile database includes thermal property data for textile fibers, yarns, and fabrics.

* * * * *